US012721416B2

(12) United States Patent
Thorn

(10) Patent No.: US 12,721,416 B2
(45) Date of Patent: Sep. 1, 2026

(54) HAIR STYLING COMB

(71) Applicant: Shawanda Monique Thorn, Prosper, TX (US)

(72) Inventor: Shawanda Monique Thorn, Prosper, TX (US)

( * ) Notice: Subject to any disclaimer, the term of this patent is extended or adjusted under 35 U.S.C. 154(b) by 48 days.

(21) Appl. No.: 18/830,819

(22) Filed: Sep. 11, 2024

(65) Prior Publication Data

US 2026/0069016 A1 Mar. 12, 2026

(51) Int. Cl.
*A45D 24/04* (2006.01)

(52) U.S. Cl.
CPC ..... *A45D 24/04* (2013.01)

(58) Field of Classification Search
CPC ..... A45D 24/00; A45D 24/04; A45D 24/06; A45D 24/08; A45D 24/10; A45D 24/12; A45D 24/14; A45D 24/16; A45D 24/18; A45D 24/36; A45D 24/42; A45D 2024/345
See application file for complete search history.

(56) References Cited

U.S. PATENT DOCUMENTS

| | | | | | |
|---|---|---|---|---|---|
| 1,700,064 | A * | 1/1929 | Lippincott | A45D 24/34 | 132/148 |
| 2,463,893 | A * | 3/1949 | Costanzo | A45D 8/12 | 132/136 |
| 2,510,943 | A * | 6/1950 | Bertrand | A45D 24/36 | 132/214 |
| 2,622,603 | A * | 12/1952 | Claps | A45D 24/36 | 132/214 |
| 3,354,890 | A * | 11/1967 | Collison | A45D 24/04 | 132/137 |
| 3,603,324 | A * | 9/1971 | Cutrone | A45D 24/04 | 132/136 |
| 4,108,186 | A * | 8/1978 | Esposto | A45D 7/04 | 132/219 |
| 5,107,869 | A * | 4/1992 | Henry | A45D 24/36 | 132/148 |
| 5,558,104 | A * | 9/1996 | Clouser | A45D 2/00 | 132/200 |
| D496,128 | S * | 9/2004 | Antonopoulos | D28/21 | |
| 8,800,572 | B1 * | 8/2014 | Hodge | A45D 24/36 | 132/213.1 |
| D997,451 | S * | 8/2023 | Horton | D28/34 | |
| D1,032,088 | S * | 6/2024 | Fisher | D28/21 | |
| 2022/0295963 | A1 * | 9/2022 | Sung | A45D 24/02 | |

FOREIGN PATENT DOCUMENTS

| | | | | |
|---|---|---|---|---|
| CN | 101869383 | A * | 10/2010 | |
| CN | 204743001 | U * | 11/2015 | |
| CN | 110063561 | A * | 7/2019 | A45D 24/04 |
| KR | 20210009581 | A * | 1/2021 | A46B 5/0012 |

* cited by examiner

*Primary Examiner* — Edelmira Bosques
*Assistant Examiner* — Lina Faraj
(74) *Attorney, Agent, or Firm* — Harpman & Harpman

(57) ABSTRACT

A hair styling comb for determining hair parts critical in hair braiding. The hair styling comb has a comb body with an extending rattail styling rod extending therefrom. The comb body has a plurality of evenly spaced teeth with a telescopically extensible spacing end tine that can extend to predetermined spacing distances for defining the perfect part for hair braiding.

1 Claim, 5 Drawing Sheets

HAIR STYLING COMB

BACKGROUND OF THE INVENTION

1. Technical Field

The present invention relates to combs for hair styling and specifically for combs used to determine hair parts for styling requirements such as braids.

2. Description of Prior Art

Prior art devices of this type disclose a variety of comb configurations with different comb teeth positioning and comb hair engagement aids, see for example U.S. Pat. Nos. 4,108,186, 5,240,017, 5,704,376 and 7,891,364.

In U.S. Pat. No. 4,108,186 a comb for sub-dividing hair is disclosed having a main comb body with different depth teeth. A slide is movable along the comb base and handle having a tapered end overlying the comb teeth.

U.S. Pat. No. 5,240,017 claims a braiding comb having teeth in spaced pattern. A flat flexible bar extends from the comb forming a tapered space for holding sections of hair.

U.S. Pat. No. 5,704,376 illustrates a strand separating comb configuration for braiding with a handle and a platform having an upper defined shell and anchor portion. Comblike teeth extend from the anchor portion with the upper shell to prevent tangles in the braided hair.

U.S. Pat. No. 7,891,364 discloses a hair style comb comprising a body having a handle, release cone and a guide measuring system that combine to precisely separate the hair in orderly rows for braiding. Each section is radially measured by successive placement of the comb measuring section on the scalp.

SUMMARY OF THE INVENTION

A hair styling comb that aids in determining hair parts that are perpendicularly spaced in horizontal and vertical axis on the scalp. An extensible measuring guide spacing tine is selectively deployed from the cone body defining exact linear spacing chosen by the hair stylist to create precision parts. A set of predetermined spacing distances are available. A release and locking mechanism assures quick deployment and retraction for differential spacing needs as required.

DETAILED DESCRIPTION OF THE INVENTION

Figure 1:
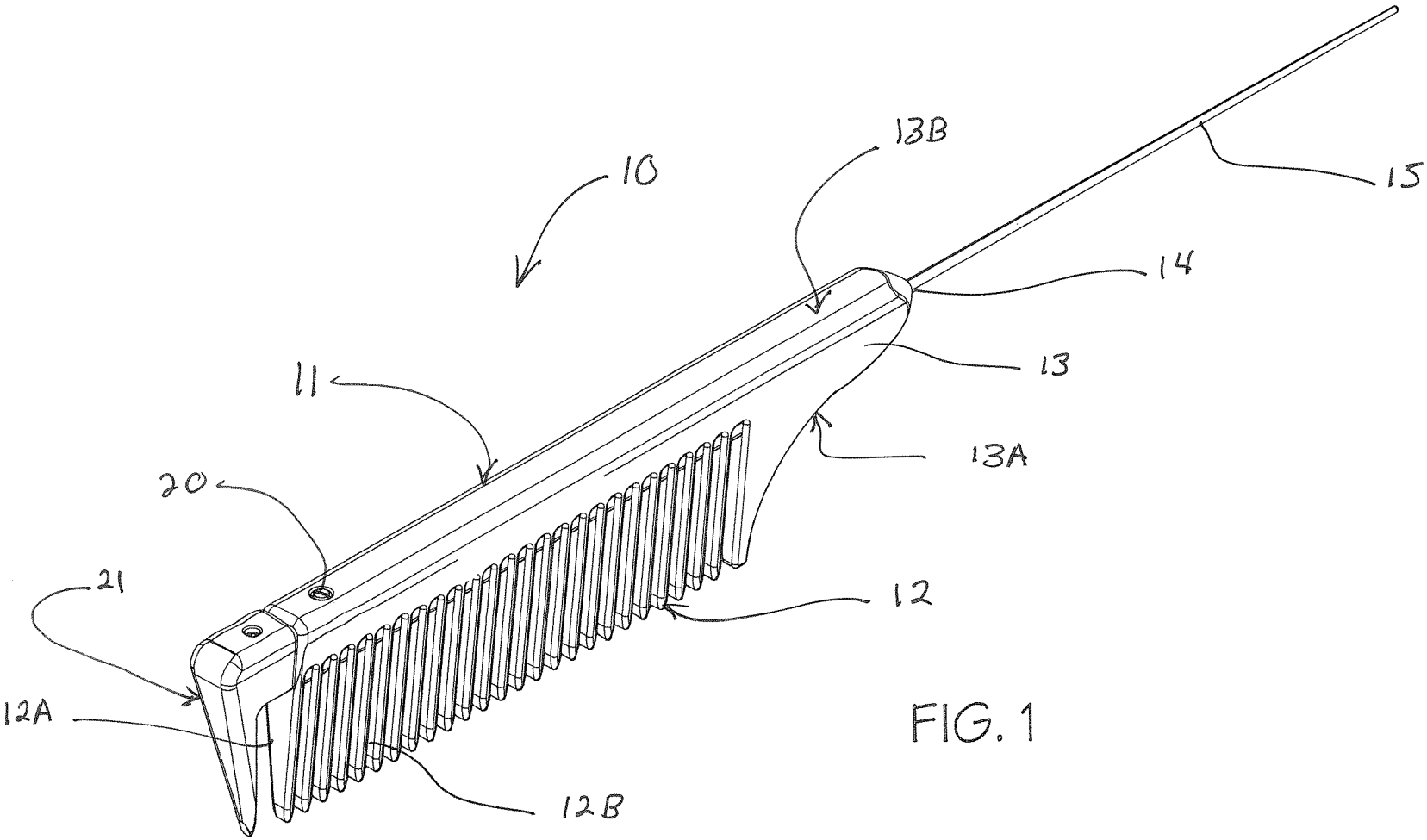
FIG. 1 is a perspective view of the adjustable hair styling comb of the invention in closed position.
Figure 2:
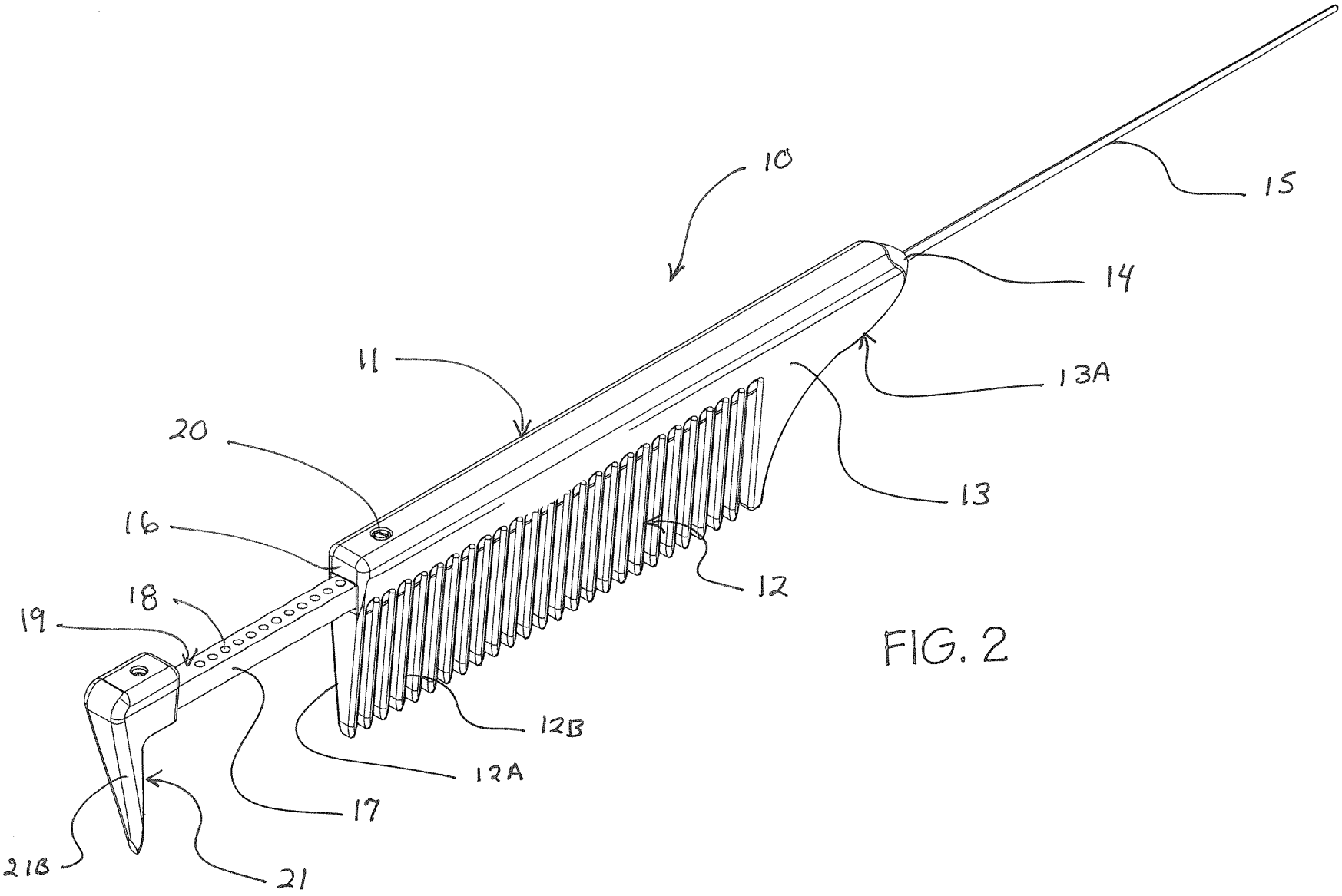
FIG. 2 is a perspective view of the adjustable hair styling comb in opened spaced display use position.
Figure 3:
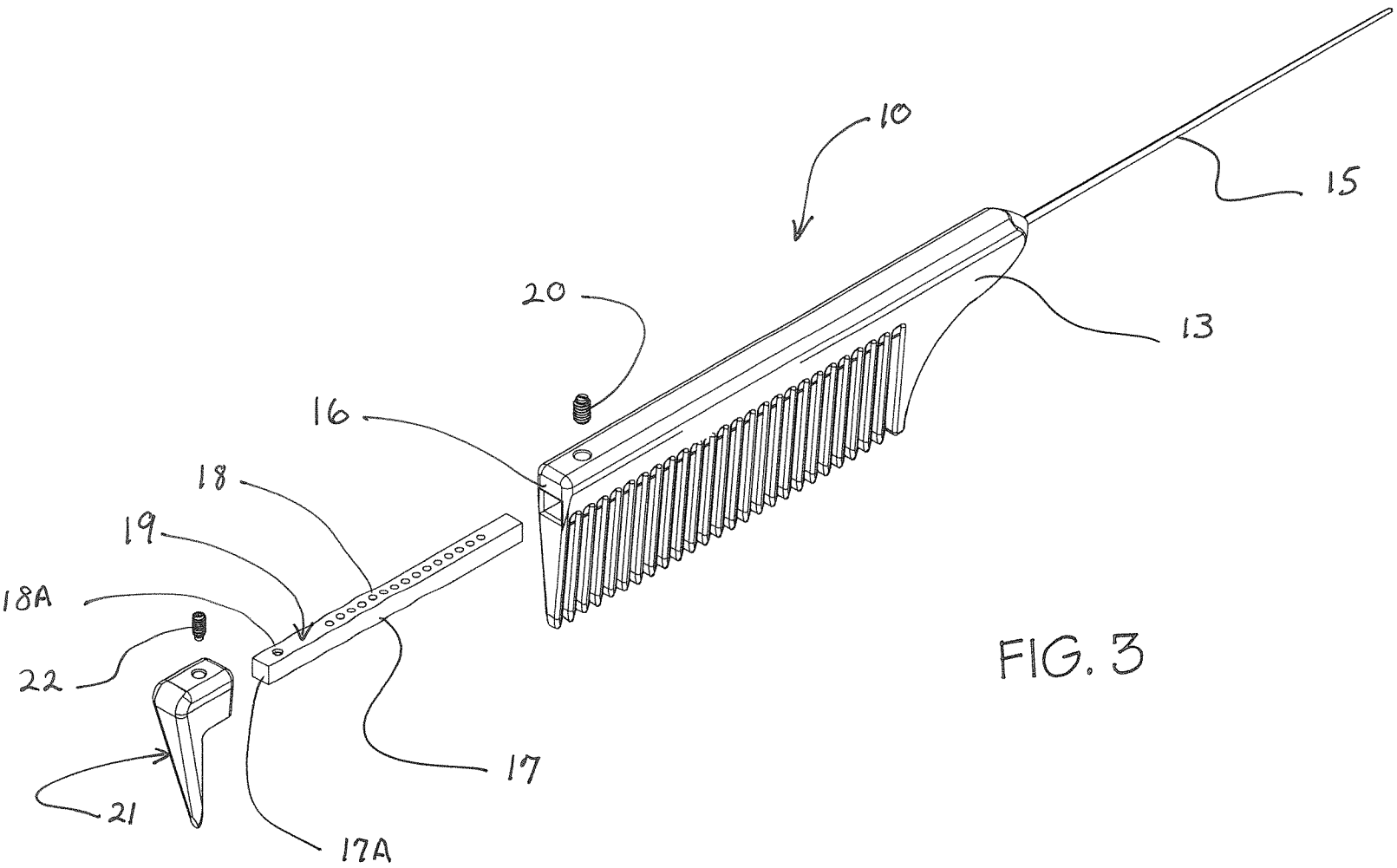
FIG. 3 is an exploded perspective view thereof.
Figure 5:
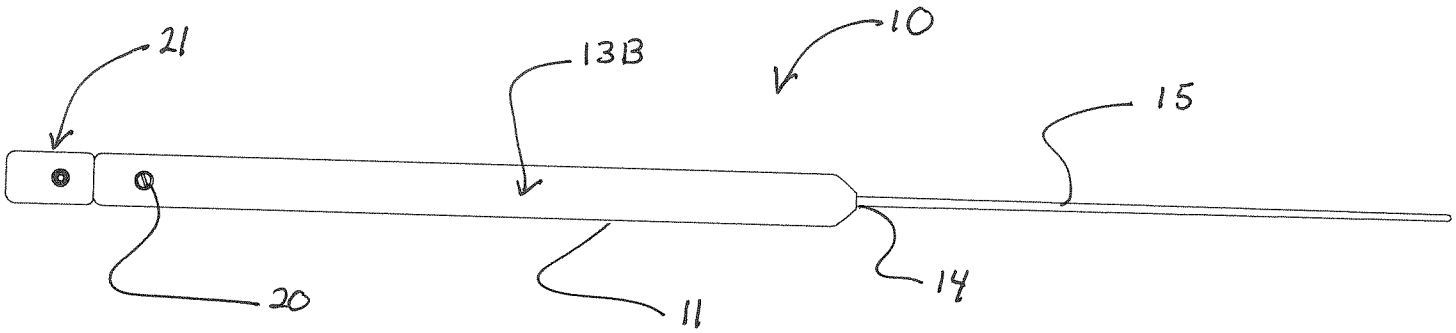
FIG. 5 is a top plan view thereof.
Figure 4:
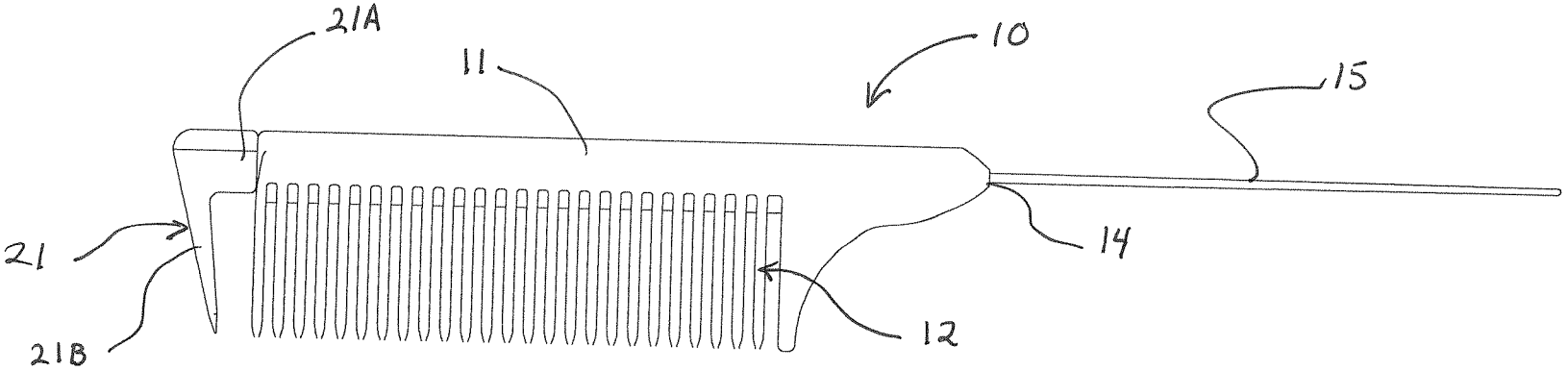
FIG. 4 is a side elevational view of the adjustable hair styling comb in closed position.

Referring to FIGS. 1-3 of the drawings, an adjustable hair styling comb 10 of the invention can be seen having a main elongated body member 11 with a plurality of spaced parallel teeth 12 extending there from. Each of the respective teeth are of equal length and thickness characterized by tapered side edges 12A and 12B.

The main body member 11 has a handle extension portion 13 with a contoured bottom edge surface 13A and a transversely flat upper surface 13B terminating together at an apertured end surface 14. A hair styling so called "rat tail" rod 15 is inserted from and extends longitudinally from the apertured end surface 14 as best seen in FIG. 6 of the drawings.

Figure 6:
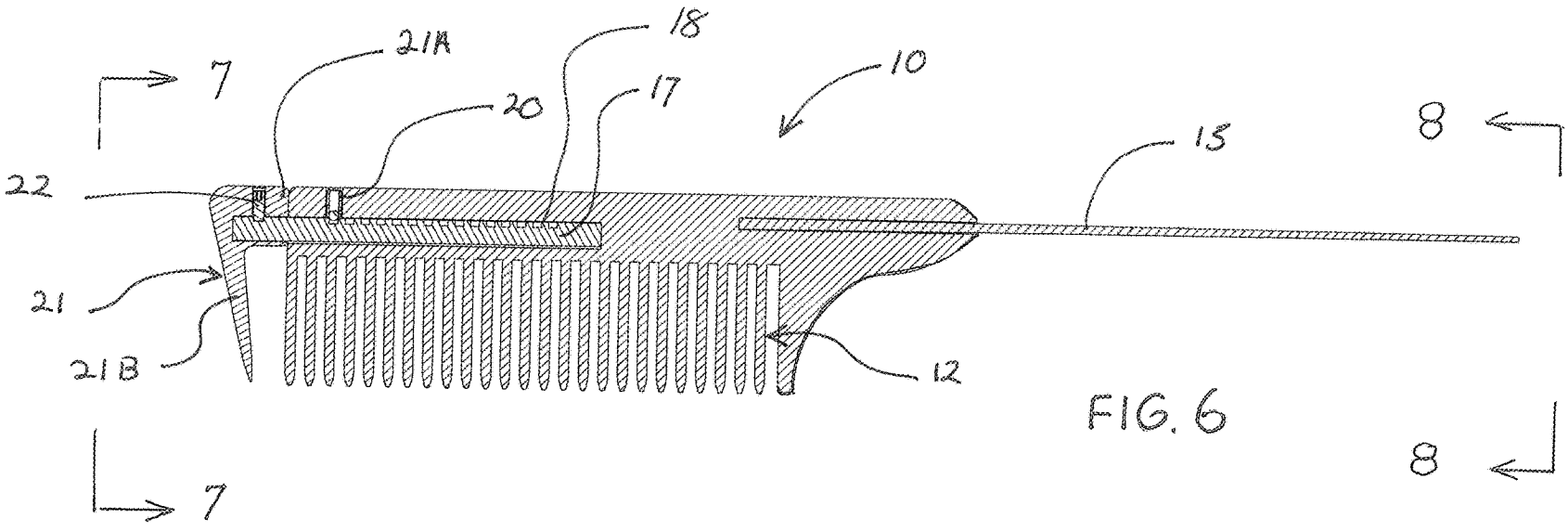
FIG. 6 is a cross-sectional view on lines 6-6 of FIG. 5.
Figure 8:
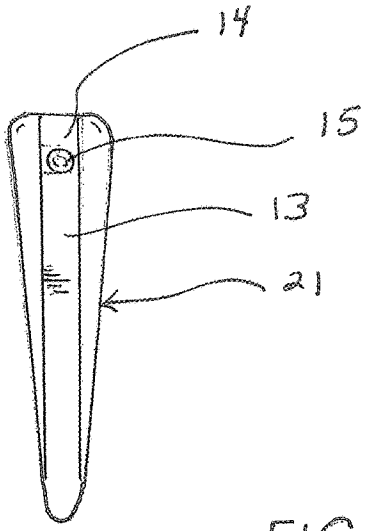
FIG. 8 is an enlarged end elevational view on lines 8-8 of FIG. 5.
Figure 7:
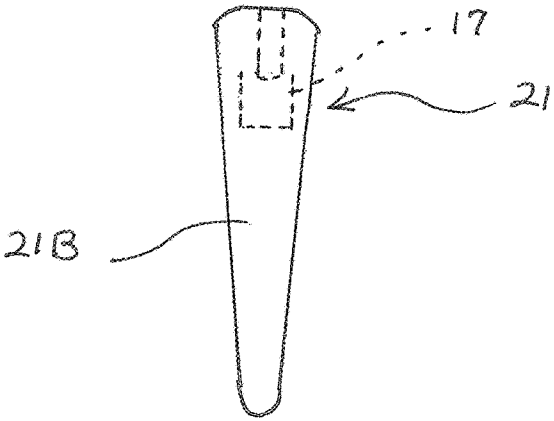
FIG. 7 is an enlarged end elevational view on lines 7-7 of FIG. 5.

Correspondingly, the main body member 11 has an apertured front end surface 16 for selectively receiving an adjustable mounting bar 17, best seen in FIGS. 3 and 6 of the drawings. The adjustable mounting bar 17 is cross-sectionally square, in this example, with a plurality of registerable indentations 18 along its upper surface 19 inwardly spaced from the respective ends 17A and 17B. The indentations 18 are in longitudinally spaced relation to one another and provide incremental engagement retainment points engageable by a resilient retainment fitting 20 that extends through the upper portion of the main body 11, best seen in FIGS. 3-6 of the drawings. A spaced fastener receiving indentation 18A is positioned adjacent the rod's free end 17A and aligned to receive a spaced end comb spacing tine 21 on its end secured by a threaded set screw fastener 22 engageable thereon.

It will be evident from the foregoing description that the adjustable deployable mounting bar 17 with its attached end spacing tine 21 can be selectively extended from within the comb's main body member 11 to specific space increments providing the hair stylist, not shown, the perfect spacing for hair parting as required in hair styling such as braiding as seen in FIG. 2 of the drawings.

End comb spacing tine 21 has a rod engagement portion 21A and an offset depending portion 21B that so defines the adjustable end tine of the hair styling comb 10. The resilient retainment fitting 20, shown in this example, see FIG. 6 of the drawings, shows a simple resilient element that provides frictional engagement against a co-pending surface such as an indexing indentation 18A and is well known and understood within the art that will thereby lock the sliding deployable bar 17 to where the user positions it in accordance with the registerable indentations 18 as hereinbefore described.

In operation, the hair stylist, not shown, simply pulls the adjustable spacing comb tine 21 outwardly from the main body member 11 to the distance desired and it locks in place for use.

From the foregoing, it will be seen that this invention is one well adapted to obtain all the ends and objects therein set forth together with the advantages which are inherent to the structure.

It will be understood that certain features and sub-combinations of the utility may be employed without reference to other features and sub-combination. It will thus be seen that a new and novel hair styling comb 10 of the invention has been illustrated and described herein and that various changes and modifications may be made thereto without departing from the spirit of the invention.

Therefore, I claim:

1. A hair styling comb comprising, an elongated body member having a handle portion, a hair styling rod extending longitudinally from a first end of said handle portion, a plurality of spaced parallel teeth extending perpendicularly from said body member, said teeth being adjacent to a second end of said handle portion opposite to the first end, a spacing tine positioned at an end surface of the body member and being separate from the teeth, said spacing tine being movable from a first position adjacent to said teeth to a second position in spaced longitudinal relation to said teeth, a spacing support bar received in a longitudinal channel within said body member and being slidable longitudinally from within said channel and out of the end surface of the body member, said spacing tine being secured to a free end of said spacing support bar by a screw fastener, such that sliding the support bar moves the spacing tine relative to the body member and the teeth, the spacing support bar further comprises a series of spaced registrable indentations along its upper surface, a resilient retainment fitting configured to extend through an aperture in an upper portion of the main body to engage with the indentations, such that the support bar can be slid longitudinally to move the spacing tine and the retainment fitting can lock the bar into a selective position and set the spacing tine at a predetermined distance when the resilient fitting is inserted into the aperture and registers with an indentation of the series of indentations.

* * * * *